United States Patent [19]

Kristoff

[11] 4,263,761

[45] Apr. 28, 1981

[54] PORTABLE ACOUSTICAL PANEL SYSTEM

[76] Inventor: Kim C. Kristoff, 3939 W. Ox Rd., Fairfax, Va. 22030

[21] Appl. No.: 10,915

[22] Filed: Feb. 9, 1979

[51] Int. Cl.[3] ..... F04B 2/74

[52] U.S. Cl. ..... 52/241; 52/64; 160/351

[58] Field of Search ..... 52/239, 241, 710, 64, 52/39, 239, 65, 127; 160/351, 135; 16/96 R, 97 R; 248/343, 317

[56] References Cited

U.S. PATENT DOCUMENTS

| | | | |
|---|---|---|---|
| 2,210,652 | 8/1940 | Dennett | 160/351 |
| 3,035,669 | 5/1962 | Graff | 52/241 |
| 3,282,006 | 11/1966 | Halsey | 52/239 |
| 3,302,691 | 2/1967 | Andrews | 16/97 |
| 3,305,983 | 2/1967 | Bus | 52/127 |
| 3,327,439 | 6/1967 | Eatough | 52/127 |
| 3,563,578 | 2/1971 | Meller | 52/710 |
| 3,589,660 | 6/1971 | Dunckel | 52/39 |
| 3,889,736 | 6/1975 | Firks | 160/351 |
| 3,949,827 | 4/1976 | Witherspoon | 52/241 |
| 4,047,337 | 9/1977 | Bergstrom | 52/71 |
| 4,121,645 | 10/1978 | Behr | 160/351 |
| 4,158,936 | 6/1979 | Fulton | 160/135 |

*Primary Examiner*—John E. Murtagh

*Attorney, Agent, or Firm*—Birch, Stewart, Kolasch & Birch

[57] ABSTRACT

A portable acoustical panel assembly is disclosed comprising a plurality of panels each including a soundproof member having rounded vertical edges for ease in rotating. Each vertical edge has at least a partial groove in its surface for receiving a flexible member for attaching the individual panels of the assembly. A supporting frame is provided, positioned about the perimeter of the soundproof member. A decorative fabric encases each panel which is provided with members for securing each panel at the top and bottom.

11 Claims, 6 Drawing Figures

PORTABLE ACOUSTICAL PANEL SYSTEM

BACKGROUND OF THE INVENTION

This invention relates to a partitioning device and more particularly to the construction of a visual ceiling to floor room divider, panel or privacy screen which is completely self-containined, easily installed and readily adaptable to generally any existing structural configuration.

It is extremely desirable to be able to provide partitioning devices that can be erected within the confines of any standard room configuration quickly and economically. Such a device should be adaptable to both commercial and domestic environments thus providing a broader scope of application. The use of room dividers or privacy screens is quite prevalent in office and lounge areas for the purpose of partioning larger areas into more efficiently useable space. It is important that the screen or panels be such that they can be arranged in a variety of positions with respect to each other and it is highly desirable for the same panels to be fabricated of sound absorbing material to give them an even broader field of use. If the wall or panel covering is such that it is removable from the basic structure then the system becomes even more flexible, allowing for a change in design or decorating effect or for just cleaning purposes without completely replacing the particular structure.

To these ends, various attempts have been made to provide partitioning devices of the nature described above. However, sufficient versatility has not been built into the known prior art structures so as to provide the most effective product. U.S. Pat. No. 3,949,827 discloses the use of fiberglass in the preparation of a soundproof panel but generally requires custom fabrication and does not allow for on-site adjustments and flexiblity in intallation. An important reason for using transportable screens or panel assemblies in work areas is so the defined work area may be redesigned and modified as the circumstances dictate.

Other problems encountered in using prior art partitions or panel assemblies include the lack of capability in adjusting the particular partition to any desired height, the inability to adjust the layout of the partitions such that they can be effectively utilized in the space provided, lack of a proper structural design to facilitate installation and the inherent aesthetically unappealing nature of the presently available structures.

SUMMARY OF THE INVENTION

It is, therefore, an object of the present invention to provide a visual divider or partitioning member which will overcome the above-noted disadvantages.

It is a further object of the present invention to provide a partitioning divider aesthetically attractive while at the same time being very versatile and economically fabricated.

It is another object of this invention to provie a partitioning device capable of being adjusted to any desired height with the additional built in flexibility of being able to be affixed to most standard structural members utilized for room construction.

Still another object of the present invention is to provide an aesthetically attractive, sound proof space divider which is capable of being hinged to like members so that the resulting composite structure can be readily adapted to conform to the desired spacial configuration.

Yet, still a further object of the present invention is to provide a visual divider portably constructed of an aesthetic, sound-proofing material which is easily removable at the site of installation.

Other objects and further scope of applicability of the present invention will become apparent from the detailed description given hereinafter; it should be understood, however, that the detailed description and accompanying illustrations, while indicating preferred embodiments of the invention, are given by way of illustration only, since various changes and modifications within the spirit and scope of the invention will become apparent to those skilled in the art and such changes and modifications should be considered to be within the scope of this invention.

The foregoing objects and others are accomplished in accordance with the present invention, generally speaking, by providing a visual divider or softwall comprising a rigid sound-insulation material covered by a decorative fabric. The vertical edges of the resulting covered panel generally are rounded so as to provide a rotatable surface with a groove extending substantially the entire length of the respective edge. The panel is provided with a flexible hinge which fits into the groove in the edge of the panel and may perform the dual function of hinging two panels together and holding the fabric of the panel in position. The groove may extend the entire length of the panel, as stated, so as to receive one continuous hinge or it may be divided into at least two separate grooves, each groove being fitted separately with a flexible hinge. Generally, the panel assembly will include a frame about the perimeter of the sound-proofing material comprising channels for receiving the softwall at the top and supporting the softwall at the bottom. Each panel will preferably be constructed of two sheets of the sound-proofing or softwall material juxtaposed about a divider or septum. The vertical ends of the panel assembly are provided with end caps which are half round on the outside edge and fit against the wall board and having the above-mentioned groove formed therein. The bottom of the panel is provided with an adjustable floor mounting interface, such as a spring on a loaded stop, carpet gripping channel, and the top of the panel with an interfacing clip which enables the panel to be attached to the exposed spline of a drop ceiling or with similar adjustable stop as is found on the bottom of the panel. A plurality of the panels of the present invention can be joined together in almost any configuration to form the partition wall desired.

BRIEF DESCRIPTION OF THE DRAWINGS

The present invention will become more fully understood from the detailed description given hereinbelow and the accompanying drawings which are given by way of illustration only, and not intended to limit the scope of the present invention wherein.

DETAILED DESCRIPTION OF THE DRAWINGS

Figure 1:
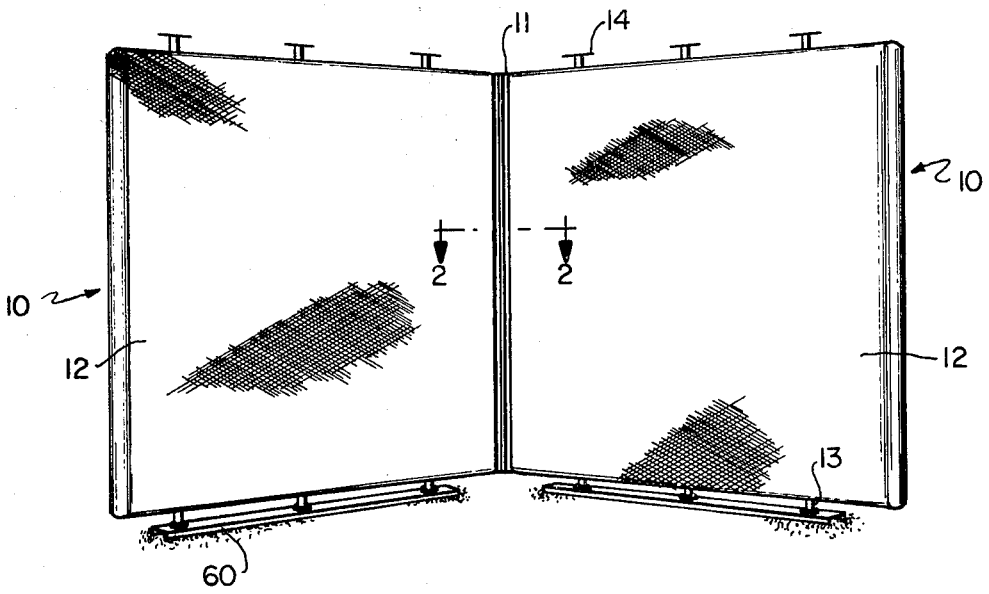
FIG. 1 is a perspective view of two dividers according to the present invention joined together by a flexible hinge.

Referring now to FIG. 1, there is seen a visual divider or space partition assembly represented in this instance as two panel assemblies of like construction designated 10 joined together by a flexible hinge 11. Each partition comprises at least one sheet of sound-insulating material covered by a decorative fabric and identified together as 12. A perimeter frame encased within the fabric covering holds the assembly together and is further discussed below. The panels are provided with adjustable floor mountings 13 and ceiling mountings 14. The flexible hinge is herein represented as being one continuous member extending the full length of the partition wall, and is the preferred embodiment for its strength and stability. However, if desired, several partial hinges may be employed in separate, distinct grooves in the edge of the respective panels.

Figure 2:
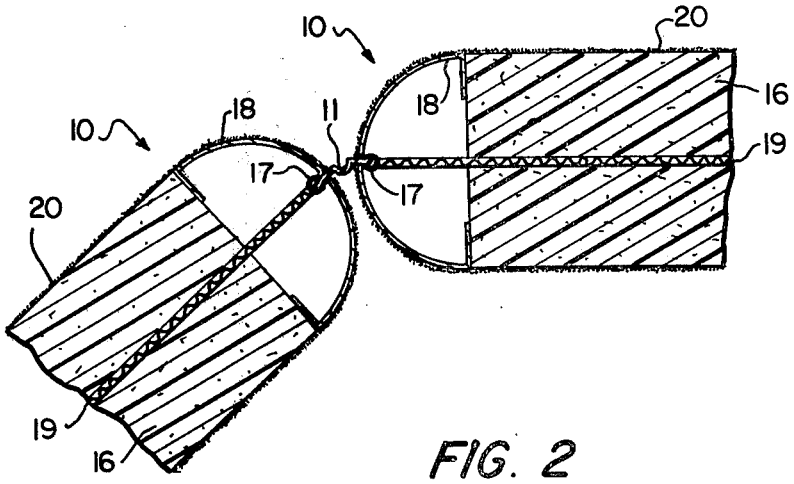
FIG. 2 is a cross-sectional view of the corner of the hinged dividers taken along line 2—2 of FIG. 1.

In FIG. 2 there is seen in cross section along line 2—2 of FIG. 1 a corner configuration of two hinged panels 10 comprising a sound-insulating material 16 having a groove 17 in the rounded edge thereof extending the length of the panel. A retaining clip or end cap 18 of a half round shape fitting flush to the panel and groove 17 and extending the length of the divider provides the vertical support of the perimeter frame for the panel. Preferrably, each panel will be constructed of two sheets of the insulating sound-proofing material 16 sandwiched about a septum 19.

Any suitable insulating sound-proofing material may be utilized as the wall board for the divider of the present invention. Typical materials include rigid fiberglass, pressed wood fiber sheeting, perforated cardboard or expanded foam. Each sheet of material will be about $\frac{3}{4}$ to $1\frac{1}{4}$ inches thick. The septum member 19 is generally about $\frac{1}{8}$ inch thick and can be made up of any suitable material which will dampen or eliminate wall vibration. Typical materials include cardboard, paper press-board, composite aluminum reinforced with foam, and "masonite" press-wood product are all preferred for their strength and lightness and economy.

Figure 6:
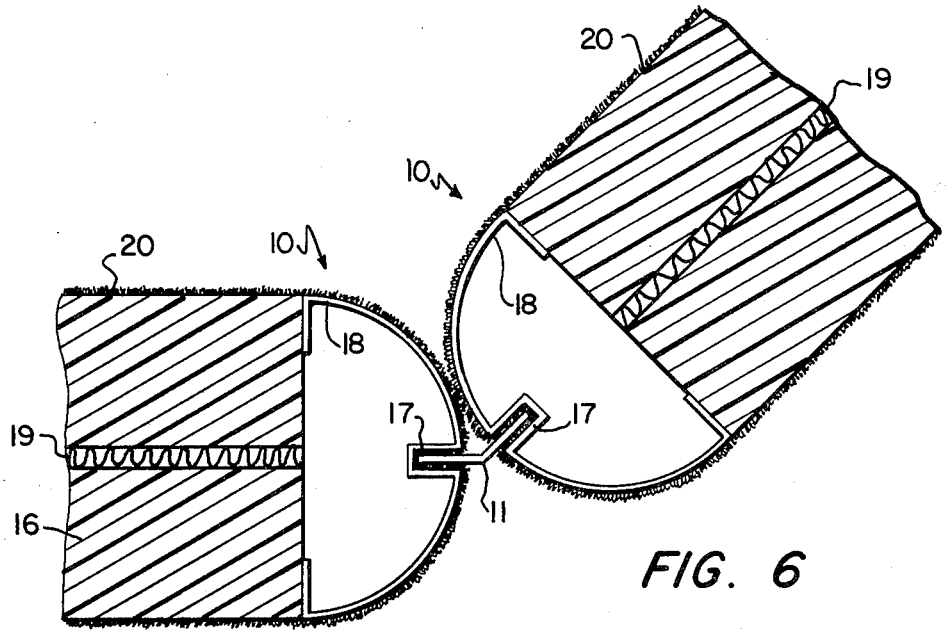
FIG. 6 is a similar view to FIG. 2 illustrating another embodiment of a flexible hinge for use with the present invention.

A fabric material 20 encases the panel wall 16 and end-cap portion 18 of the perimeter frame of the panel 10. A plastic flexible hinge or clip 11 such as polyvinyl chloride, polystyrene, polyethylene or polypropylene clip fits into the groove 17 of the two adjacent panels as illustrated in FIG. 2. The hinge 11 in the FIG. 2 embodiment serves the dual function, as stated above, of hinging the panels of the partition together for assembly in a number of positions while at the same time retaining the fabric of the fabric coated panels within the grooves or slots provided in the edges of the panels. In an alternative embodiment illustrated in FIG. 6, fabric material 20 is glued or secured in slot 17 by suitable means in addition to hinge 11. In this embodiment hinge 11 may be a semi-rigid flat plastic tape which has a slight friction fit in slots 17. The end-cap is generally constructed of an aluminum extrusion of the configuration set out in FIGS. 2 and 6, however, other types of material may be utilized such as wood, steel and various shaped plastic materials such as polyvinyl chloride, polystyrene, and similar material. The fabric material provides a decorative finish to the visual divider while at the same time being easily replaceable as the need arises. Other materials which can be utilized are perforated vinyl, perforated sheet metal, certain types of carpet or other types of woven materials.

Figure 3:
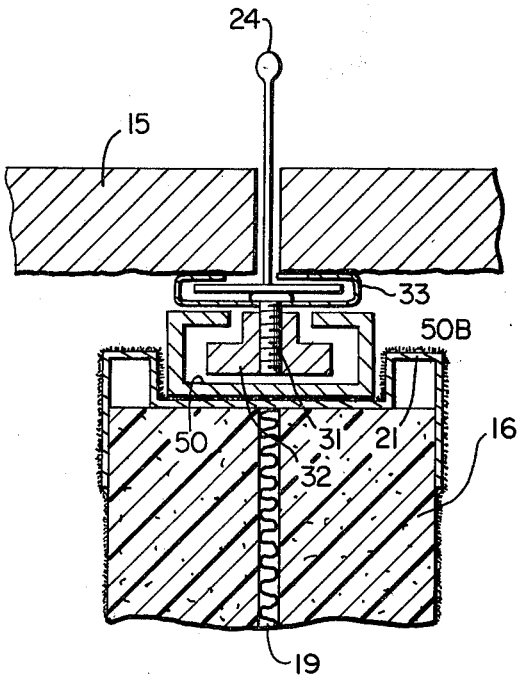
FIG. 3 is a sectional view illustrating the construction of the visual divider of the present invention fabricated such that it can be attached to a drop or hanging ceiling configuration.
Figure 4:
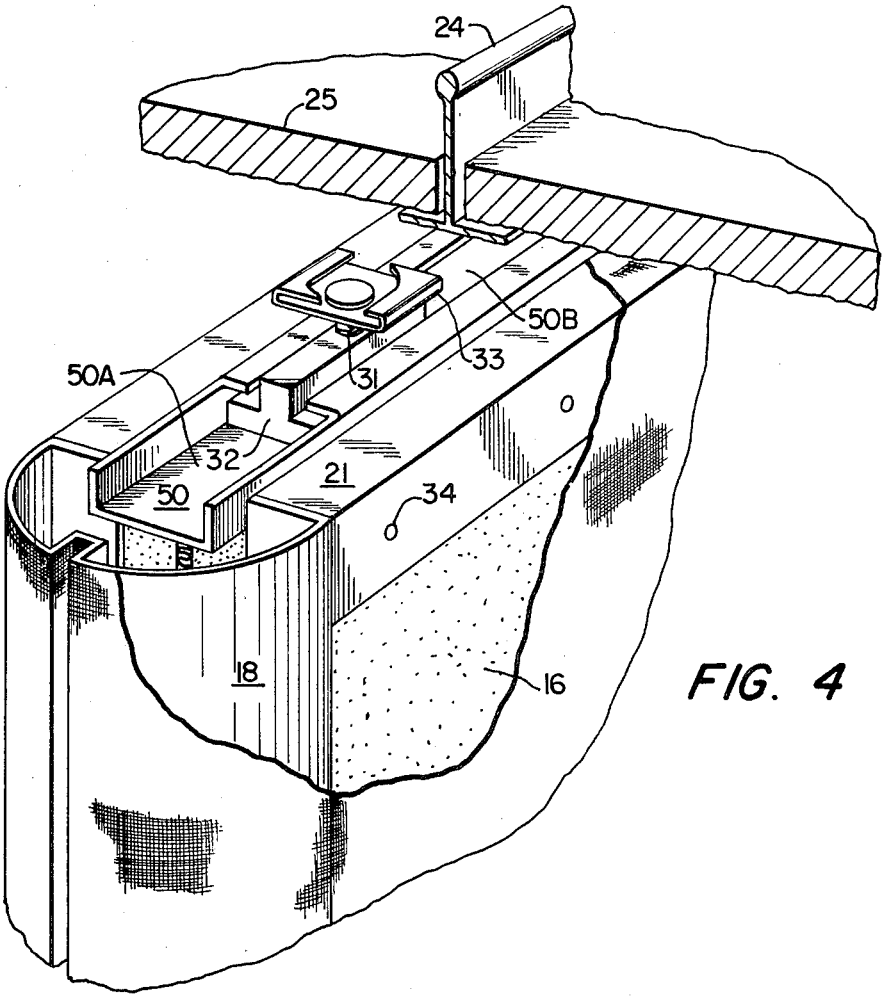
FIG. 4 is a sectional perspective view illustrating the structure of the ceiling attachment of FIG. 3 and the perimeter frame of the divider of the present invention.

FIG. 3 represents a cross section of the wall partition of the present invention at its attachment to the tiles of a hanging ceiling. The top frame member 21 of the perimeter wall frame has a horizontal portion 22 which when in place rests on the top surface of the insulating wall board 16. The fabric covering 20 encases the wall board 16 and the top frame member 21. A caddy clip or similar type hanger generally designated 30 is attached by a pin 31 to a T-shaped slide 32 which rides in a guide channel 50 secured to the top frame member 21. Guide channel 50 has a widened portion 50A at each end and a narrow central slot 50B in which slide 32 may be moved. Hanger 30 may be readily removed from guide channel 50 by moving slide 32 to widened portion 50A at either end of guide channel 50. This structure is further represented and discussed in FIG. 4 below. The hanger 30 engages a tee-spline connection 24 which supports the ceiling tile 25 as illustrated. The hanger 30 is provided such that when in place the panel assembly is securely attached to the ceiling structure by slide 32 and the flange 33 which is free to pivot about the pin member 31. In addition hanger 30 may be moved to any position along channel 50 within slot 50B.

In a perspective view of the ceiling attachment of the present invention discussed above, FIG. 4 illustrates the panel structure comprising the wall board material 16 and septum 19 being held together by end cap 18 and further covered or encased in the fabric material 20. The hanger 30 comprising pin 31, slide 32 and flange 33 is slidably mounted through channel 50. The guide channel 50 is continuous in the top frame member 21 so as to allow for positioning the partition in a variety of locations.

Figure 5:
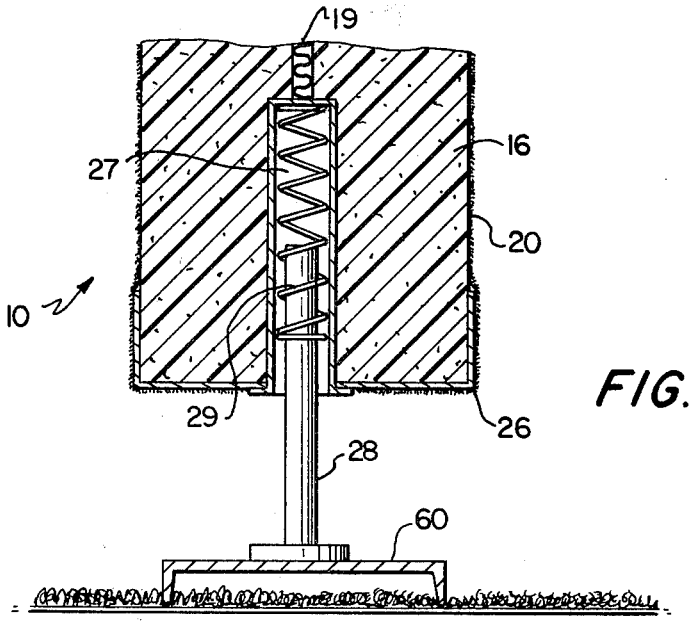
FIG. 5 is a sectional view of the floor mounting interface at the bottom of the panel of the present invention.

Referring to FIG. 5, there is seen a cross-section of the panel assembly 10 taken through the bottom of the structure at the interface with the floor. The wall structure comprising the septum 19 sandwiched between the two sheets of wallboard 16 is supported by the bottom frame member 26 of the perimeter wall frame. The fabric cover 20 encases the wallboard 16 and the bottom frame member 26. A groove 27 is provided in the bottom of the wallboard configuration to receive a supporting leg 28, herein represented to be spring loaded 29, such that it can be adjusted to the height of the space being occupied and is held in place by pressure contact with the floor. Supporting legs 28 are secured to the top of channels 60 which extend the length of the panels. The bottom edges of channel 60 are provided with serrated edges which grip a carpet on which the partition is installed. Under the circumstances when the ceiling structure is something other than a hanging ceiling the top configuration of the panel assembly can be similar to that at the bottom of the assembly.

The top and bottom frame members 21 and 26 are generally constructed of aluminum extrusion of the configurations represented in FIGS. 3 and 5. Other types of material may be used such as steel, wood and moldable plastics such as vinyl plastics. In an alternate embodiment, pins may be provided such as represented in FIG. 3 at 34, for further securing the top and bottom members of the perimeter frame. In addition, even though the pivotal ceiling attachment has been described in combination with the specific panel configuration of the present invention is should be understood that it is equally applicable to other partition members differing in structure from that herein represented.

The panel assembly of the present invention represents an easily assembled, rigid, highly stable portable divider providing the necessary acoustical properties and, especially, versatility with respect to the spacial arrangements for which it finds application. The structure is of high strength light materials while at the same time being aesthetically appealing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A partition wall assembly comprising in combination a plurality of panels each including at least one sheet of a soundproof member, said panels having rounded vertical edges providing a rotatable surface with a groove extending substantially the length thereof, a frame positioned about the perimeter of said soundproof member, a decorative sheet material encasing said frame and said soundproof member, a flexible means engaging said groove for attaching each of said panels one to the other, means for securing each panel to the floor and the frame of a suspended ceiling, respectively, said means for securing the panel of said wall assembly to the ceiling comprising a pivotally mounted clip having a bottom end slideably attached to the top of said perimeter frame and a top end releasably connected to said ceiling frame, and a guide channel on the top of said perimeter frame in which said pivotally mounted clip is slideably mounted, said guide channel having a guide slot in which said clip is mounted and at least one enlarged opening through which said clip may be removed.

2. The partition wall assembly as defined in claim 1, wherein said flexible means for attaching said panels comprises a plastic, flexible hinge which extends substantially the entire vertical length of said panels.

3. The wall assembly as defined in claim 1 wherein said frame comprises top and bottom channels for receiving the respective portions of said soundproof member and vertical end caps having rounded vertical edges providing said rotatable surface.

4. The partition wall assembly as defined in claim 1, wherein said means for securing the panel of said wall assembly to the floor comprises an adjustable floor mounting interfacing with said floor.

5. The wall assembly as defined in claim 4, wherein said floor mounting comprises a spring loaded stop with carpet gripper.

6. The partition wall assembly as defined in claim 1, wherein said soundproof member comprises two sheets of soundproof material juxtaposed about a dividing septum.

7. The partition wall assembly as defined in claim 6, wherein said septum comprises a thin sheet of carboard having a thickness of about $\frac{1}{8}$ inch.

8. A partition wall assembly comprising in combination a plurality of panels each including at least one sheet of a soundproof member, a frame positioned about the perimeter of said soundproof member, a decorative sheet material encasing said frame and soundproof member, means for securing each panel to the floor and ceiling respectively, said ceiling securing means comprising a pivotally mounted clip slideably attached to the top of said perimeter frame and a guide channel on the top of said perimeter frame in which said pivotally mounted clip is slideably mounted, said guide channel having a guide slot in which said clip is mounted and at least one enlarged opening through which said clip may be removed.

9. The partition wall assembly as defined in claim 8, wherein said soundproof member comprises two sheets of soundproof material positioned about a dividing septum.

10. The partition wall assembly as defined in claim 1, wherein said flexible hinge is friction fit into said grooves in said rounded vertical edges and said decorative sheet material is tucked into said grooves, whereby said flexible hinge helps retain said sheet material in said grooves.

11. A partition-wall assembly for use with a suspended ceiling structure including in combination a plurality of panels each including acoustically absorbent material, a frame positioned about the perimeter of said acoustically absorbent material, and means for securing each panel to a linear support member of said suspended ceiling structure and the oppositely disposed floor, the improvement comprising:

a guide channel on the top of said perimeter frame;

a slide member mounted for movement within said guide channel;

clip means having a bottom end pivotally connected to said slide member and a top end releasably connectable to said linear support member; and spring-loaded support means extending from the bottom of said partition for resiliently supporting a portion of the weight of said partition on said floor.

* * * * *